US009408774B2

(12) United States Patent
Rafaeli

(10) Patent No.: US 9,408,774 B2
(45) Date of Patent: Aug. 9, 2016

(54) PORTABLE DEVICE FOR TRAINING, EXERCISING AND PAIN RELIEF UTILIZING ROTATABLE ECCENTRIC MASSES

(75) Inventor: Dolev Rafaeli, Cresskill, NJ (US)

(73) Assignee: RADIANCY INC., Orangeburg, NY (US)

( * ) Notice: Subject to any disclaimer, the term of this patent is extended or adjusted under 35 U.S.C. 154(b) by 828 days.

(21) Appl. No.: 13/499,699

(22) PCT Filed: Oct. 13, 2010

(86) PCT No.: PCT/IL2010/000835

§ 371 (c)(1), (2), (4) Date: Apr. 1, 2012

(87) PCT Pub. No.: WO2011/045787

PCT Pub. Date: Apr. 21, 2011

(65) Prior Publication Data

US 2012/0196729 A1 Aug. 2, 2012

Related U.S. Application Data

(60) Provisional application No. 61/251,531, filed on Oct. 14, 2009.

(51) Int. Cl.
*A61H 23/00* (2006.01)
*A63B 21/06* (2006.01)
(Continued)

(52) U.S. Cl.
CPC ..... *A61H 23/0263* (2013.01); *A63B 21/00196* (2013.01); *A63B 21/06* (2013.01); *A63B 21/065* (2013.01); *A63B 21/1419* (2013.01);
(Continued)

(58) Field of Classification Search
CPC ..... A61H 23/0263; A61H 23/0272; A61H 23/0281; A63B 21/06; A63B 21/08; A63B 21/065; A63B 21/1419; A63B 21/072
See application file for complete search history.

(56) References Cited

U.S. PATENT DOCUMENTS 850,938 A 4/1907 Kellog
1,013,782 A * 1/1912 Koch ..... 482/108
(Continued)

FOREIGN PATENT DOCUMENTS

JP H02-277454 11/1990

OTHER PUBLICATIONS

Office Action from Japanese Patent Office for Parallel Application JP 2012-533737 Dated Oct. 28, 2014.
(Continued)

*Primary Examiner* — Justine Yu
*Assistant Examiner* — Timothy Stanis
(74) *Attorney, Agent, or Firm* — Simon Kahn; Chanoch Kahn

(57) ABSTRACT

A portable device for training and exercising constituted of: a shakable member; a rotational member in communication with the shakable member, the rotational member exhibiting an axis of rotation; a mass exhibiting a center of gravity in communication with the rotational member, the center of gravity of the mass offset from the axis of rotation of the respective rotational member; a motor in communication with the rotational member and arranged to rotate the rotational member about the respective axis of rotation thereof responsive to the at least one motor; and a control circuitry in communication with the motor, the control circuitry arranged to operate the motor so as to irregularly rotate the rotational member to thereby shake the shakable member.

15 Claims, 9 Drawing Sheets

(51) Int. Cl.

| | |
|---|---|
| ***A61H 23/02*** | (2006.01) |
| ***A63B 21/00*** | (2006.01) |
| ***A63B 21/065*** | (2006.01) |
| *A63B 21/072* | (2006.01) |

(52) U.S. Cl.
CPC ..... *A63B21/4009* (2015.10); *A63B 21/072* (2013.01); *A63B 2220/40* (2013.01)

(56) References Cited

U.S. PATENT DOCUMENTS

| | | | | |
|---|---|---|---|---|
| 3,617,056 | A | 11/1971 | Herbold | |
| 4,702,474 | A | 10/1987 | Guibert | |
| 4,890,831 | A | 1/1990 | Craig | |
| 5,169,364 | A * | 12/1992 | Donaldson | 482/105 |
| 5,254,063 | A | 10/1993 | House | |
| 5,807,215 | A | 9/1998 | Abe et al. | |
| 5,868,653 | A | 2/1999 | Klasen | |
| 5,888,174 | A | 3/1999 | Schlee | |
| 5,909,074 | A * | 6/1999 | Takaya et al. | 310/81 |
| 6,039,679 | A | 3/2000 | Yu | |
| 6,179,758 | B1 * | 1/2001 | Domenge | 482/110 |
| 6,659,918 | B2 | 12/2003 | Schiessl | |
| 6,837,833 | B2 | 1/2005 | Elledge | |
| 6,981,933 | B2 | 1/2006 | Scafidel | |
| 2003/0083599 | A1 | 5/2003 | Kitov | |
| 2004/0198569 | A1 | 10/2004 | Sanford-Schwentke et al. | |
| 2006/0105890 | A1 | 5/2006 | Logue | |
| 2007/0051373 | A1 | 3/2007 | Lin | |
| 2007/0259759 | A1 | 11/2007 | Sumners et al. | |
| 2007/0298941 | A1 | 12/2007 | Egger | |
| 2008/0139370 | A1 * | 6/2008 | Charnitski | 482/139 |
| 2009/0177126 | A1 | 7/2009 | Berger et al. | |
| 2012/0088640 | A1 * | 4/2012 | Wissink et al. | 482/110 |

OTHER PUBLICATIONS

Clyde Soles, "vibration training", Fitness, 2006, pp. 42-45, GearTrends.

Screen Shot of article "Body-vibration Osteoporoses or Osteopenia your solution?", posted on http://www.osteopenia3.com/Body-vibration-Osteoporosis.html, accessed Aug. 4, 2009.

International Search Report for parallel International Application PCT/IL2010/000835, issued by European Patent Office on Mailing Date of Mar. 30, 2011.

Written Opinion of International Search Report for parallel International Application PCT/IL2010/000835, issued by European Patent Office on Mailing Date of Mar. 30, 2011.

Office Action for parallel Chinese Application No. 201080042354.2, issued by Chinese Patent Office on Aug. 28, 2013.

Office Action for parallel Australian Application No. 2010307969, issued by Australian Patent Office on Sep. 20, 2013.

* cited by examiner

PORTABLE DEVICE FOR TRAINING, EXERCISING AND PAIN RELIEF UTILIZING ROTATABLE ECCENTRIC MASSES

BACKGROUND

Muscle exercising can be accomplished in many different ways including by a stationary individual or by an individual generally moving about. A very large selection of devices exists that provide for exercising of muscles, including without limitation, devices based on dead weights and devices based on active weights. Some of the simpler dead weight devices comprise dumbbells, typically composed of a short bar with large heavy balls or disks at opposing ends of the short bar, the short bar typically held with one hand, and barbells which are generally similar but composed of a longer bar meant to be held with two hands. The main common drawbacks of these devices are the amount of time and energy needed for a successful productive workout and the danger of cramping of the muscles. In particular, training with dumbbells and/or barbells places a high requirement on the endurance of the user, since measurable success requires a significantly long period of repetitive use.

Muscle stimulation by vibration is thought to exercise muscles by invoking a muscle's natural involuntary reflexive, or stretch, response, by imparting a sudden increase in load on the muscle over a predefined time period and over a predetermined amplitude. Such devices are commercially available, typically as whole body vibration platforms. However, such a platform does not allow for exercise of specific muscles.

U.S. Pat. No. 5,868,653, issued Feb. 9, 1999 to Klasen, the entire contents of which are incorporated herein by reference, is addressed to a vibrating barbell which includes a substantially tubular shaped barbell bar enclosing a device which causes the barbell bar to vibrate, comprising weights attached to each end of the barbell bar and a damping material interposed between the barbell bar and the weights. It is believed that the vibrations stimulate the nerves that coordinate the sequence of movement, and thus a more marked hypertrophy of the muscles used in lifting the device is noted with a reduced tendency to develop cramps. Disadvantageously, the majority of the benefit of the device remains solely a function of lifting the vibrating barbell, and is typically a function of the amount of repetition and continuous increase in the weight level being lifted. Further disadvantageously, the vibration rate and amplitude is not adjustable.

There is thus a long felt need for a device allowing for variable vibration speed and amplitude, which can be applied to specific muscles, or muscle groups.

SUMMARY

Accordingly, it is a principal object of the present invention to overcome at least some of the disadvantages of the prior art. In certain embodiments this is provided by a portable device comprising a shakable member, at least one rotational member and at least one eccentric mass in communication with each rotational member. The rotational member is in communication with a motor, the motor responsive to a control circuitry. The control circuitry is arranged to irregularly rotate the at least one rotational member so as to shake the shakable member. The term shake is defined as to move or sway with short, quick, irregular vibratory movements.

In an exemplary embodiment, a portable device is provided, the portable device comprising: a shakable member; at least one rotational member in communication with the shakable member, each of the at least one rotational member exhibiting a respective axis of rotation; at least one mass exhibiting a center of gravity, each of the at least one mass in communication with a particular one of the at least one rotational member, the center of gravity of each mass offset from the axis of rotation of the respective rotational member; at least one motor in communication with the at least one rotational member and arranged to rotate the at least one rotational member about the respective axis of rotation thereof; and a control circuitry in communication with the at least one motor, the control circuitry arranged to operate the at least one motor so as to irregularly rotate the at least one rotational member to thereby shake the shakable member.

In one embodiment the irregular rotation comprises a random adjustment of one of frequency and amplitude of rotation. In another embodiment the portable device further comprises an extremity adaptor secured in relation to the shakable member, the extremity adaptor arranged to receive a portion of a user's extremity therein, thus providing training or exercising of muscles of the user's extremity responsive to the shake of the shakable member.

In one embodiment the portable device further comprises a double leg adaptor secured in relation to the shakable member, the double leg adaptor arranged to receive a portion of a pair of user's legs therein, thus providing lower back pain relief responsive to the shake of the shakable member. In another embodiment the portable device further comprises an abdomen adaptor secured in relation to the shakable member, the abdomen adaptor arranged to receive a portion of a user's abdomen therein, thus providing lower back pain relief responsive to the shake of the shakable member.

In one embodiment the shakable member is a straight bar. In another embodiment the at least one rotational member comprises two rotational members and the at least one mass comprises two masses.

In one further embodiment the control circuitry is arranged to rotate the two rotational members such that the two masses rotate in-phase. In another further embodiment the control circuitry is arranged to rotate the two rotational members such that the two masses rotate out of phase.

In one embodiment the amount of the offset is adjustable. In another embodiment the rotational axis of the at least one rotational member is parallel to a longitudinal axis of the shakable member.

In one embodiment the rotational axis of the at least one rotational member is perpendicular to a longitudinal axis of the shakable member. In another embodiment the portable device further comprises a user input device in communication with the control circuitry, the control circuitry arranged to select a range of rotational frequencies responsive to the user input device.

In one embodiment the at least one mass is a free mass. In another embodiment the at least one mass is constrained to substantially move only vertically responsive to the rotation of the at least one rotational member.

Independently, a method for training, exercising or pain relief is provided, the method comprising: providing a shakable member; providing at least one eccentric mass in communication with the shakable member; and irregularly eccentrically moving the at least one eccentric mass, the irregular eccentric motion of the provided at least one eccentric mass shaking the shakable member.

In one embodiment the irregularly eccentrically moving of the at least one eccentric mass comprises irregularly eccentrically rotating the at least one eccentric mass. In one further embodiment the irregularly eccentrically rotation of the at least one eccentric mass is about an adjustable rotational radius. In another further embodiment the irregularly eccentrically rotating comprises randomly adjusting one of frequency of rotation and amplitude of rotation.

In another embodiment the at least one eccentric mass comprises two eccentric masses. In one further embodiment the irregularly eccentrically moving of the two eccentric masses comprises irregularly eccentrically rotating the two eccentric masses in-phase. In another further embodiment the irregularly eccentrically moving of the two eccentric masses comprises irregularly eccentrically rotating the two eccentric masses out of phase.

In one embodiment the provided at least one eccentric mass is a free mass. In another embodiment the method further comprises constraining the provided at least one mass to substantially move only vertically.

In one embodiment the method further comprises securing the shakable member in relation to a user's extremity, thus providing training or exercising of muscles of the user's extremity responsive to the shaking of the shakable member. In another embodiment the method further comprises securing the shakable member in relation to a pair of user's legs, thus providing lower back pain relief responsive to the shaking of the shakable member. In one embodiment the method further comprises securing the shakable member in relation to a user's abdomen, thus providing lower back pain relief responsive to the shaking of the shakable member.

Additional features and advantages of the invention will become apparent from the following drawings and description.

BRIEF DESCRIPTION OF THE DRAWINGS

For a better understanding of various embodiments of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION

Figure 1A:
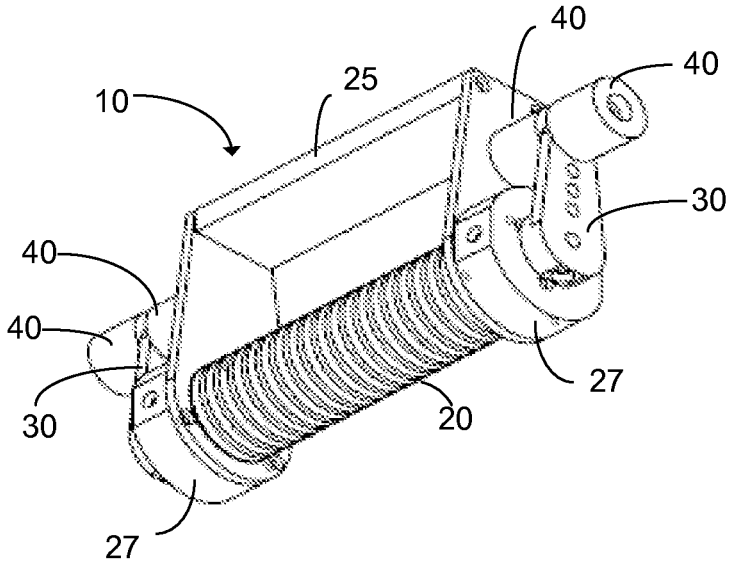
FIG. 1A illustrates a perspective view of a first embodiment of a portable device for training and exercising.

Before explaining at least one embodiment in detail, it is to be understood that the invention is not limited in its application to the details of construction and the arrangement of the components set forth in the following description or illustrated in the drawings. The invention is applicable to other embodiments being practiced or carried out in various ways. Also, it is to be understood that the phraseology and terminology employed herein is for the purpose of description and should not be regarded as limiting.

The device is herein described primarily as being useful for training and exercising, however this is not meant to be limiting. In certain embodiments the device is utilized to relieve pain, particularly lower back pain.

Figure 1B:
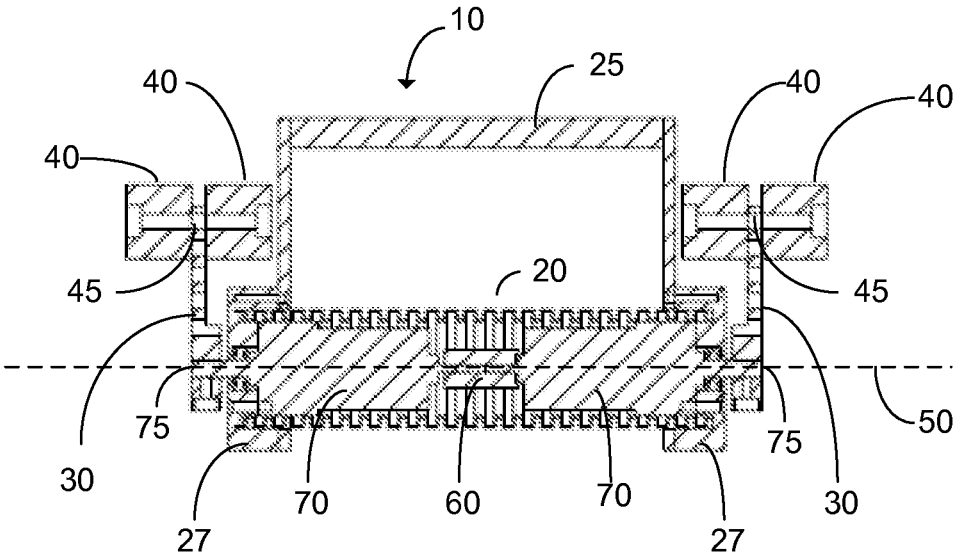
FIG. 1B illustrates a side cut view of the first embodiment of the portable device for training and exercising of FIG. 1A.
Figure 1C:
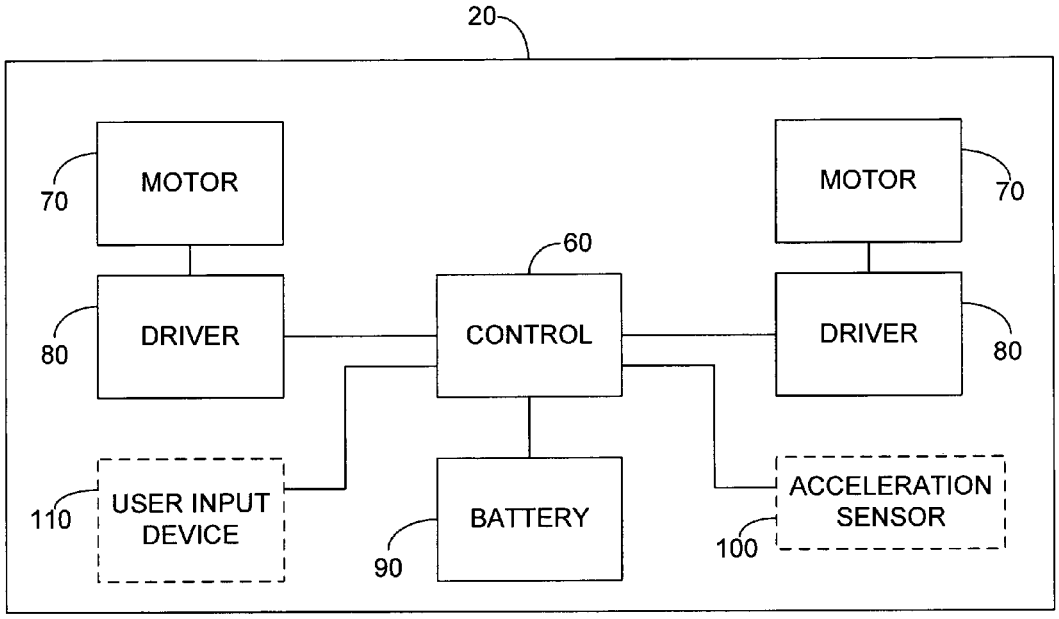
FIG. 1C illustrates a high level schematic diagram of the control circuitry of the first embodiment of the portable device for training and exercising of FIG. 1A.

FIG. 1A illustrates a perspective view of a first embodiment of a portable device 10 useful for training and exercising, FIG. 1B illustrates a side cut view of portable device 10 and FIG. 1C illustrates a high level electrical schematic diagram of the control circuitry of portable device 10, the figures taken together. In particular, portable device 10 comprises: a shakable member 20; a frame 25; a plurality of nuts 27; a plurality of rotatable members 30; a plurality of masses 40; a plurality of centers of gravity 45 each associated with one or more masses 40; a longitudinal axis 50; a control circuitry 60; and a plurality of motors 70 each exhibiting a rotating shaft 75. Control circuitry 60 further comprises a plurality of drivers 80, a battery 90, an optional acceleration sensor 100 and an optional user input device 110. Longitudinal axis 50 is the longitudinal axis of shakable member 20.

In one non-limiting embodiment, as illustrated, shakable member 20 is a straight bar, and frame 25 is a C shaped member connected to opposing ends shakable member 20 and functions as a handgrip. Plurality of masses 40 are illustrated as circular masses, however this is not meant to be limiting in any way and masses of any shape can be used. Two masses 40 are illustrated, each connected to a particular rotatable member 30, however this is not meant to be limiting in any way and any number of masses 40 can be connected to each rotatable member 30. A plurality of motors 70 and a plurality of drivers 80 connected respectively thereto are illustrated, however this is not meant to be limiting in any way. In one embodiment only one motor 70 and one driver 80 connected thereto is provided.

Shakable member 20 is a hollow member, with a pair of motors 70 placed within shakable member 20 so that rotating shaft 75 of each motor 70 extends past the respective end of shakable member 20. In one embodiment frame 25 is secured to opposing ends of shakable member 20 by a pair of nuts 27 exhibiting a central pass through for the respective rotating shaft 75. Each motor 70 is associated with a particular rotatable member 30 connected to a distal end of the respective rotating shaft 75, and arranged to rotate responsive to rotation of the respective rotating shaft 75. In an exemplary embodiment, the rotational axis of rotating shaft 75, the rotational axis of rotatable member 30 and longitudinal axis 50 coincide. Each rotatable member 30 extends radially from the connection to the respective rotating shaft 75, and a pair of masses 40 is connected to each rotatable member 30 at a point distal of the longitudinal axis 50. The pair of masses 40 connected together exhibit a respective center of gravity 45. Thus masses 40 represent eccentric masses in respect to longitudinal axis 50, since center of gravity 45 is offset from longitudinal axis 50.

Control circuitry 60 is connected to battery 90 and to plurality of drivers 80. Each driver 80 is connected to a respective motor 70. In an embodiment wherein only one motor 70 is provided, motor 70 is connected to each rotatable member 30. In one embodiment, not shown, portable device 10 further exhibits a power line connection and battery 90 is connected thereto, thereby providing means for recharging battery 90. Optional acceleration sensor 100 is connected to an input of control circuitry 60 and optional user input device 110 is connected to an input of control circuitry 60.

In operation, a user grips shakable member 20, and preferably operates optional user input device 110. Control circuitry 60 is operative, responsive to optional user input device 110, to irregularly operate each of plurality of motors 70, via respective drivers 80, thereby rotating each respective rotatable member 30. In particular, control circuitry 60 is preferably operative to randomly adjust at least one of the frequency of rotation and amplitude of rotation of the respective motor 70. The amplitude of rotation is defined herein as the amount of rotation of the respective rotatable member 30, over a pre-determined time period, preferably measured in one or more of degrees, radians, or complete circuits. Each mass 40 is thus irregularly rotated around longitudinal axis 50 and shakable member 20 is thus shaken thereby training or exercising the muscles of a user holding shakable member 20. After a pre-determined time period control circuitry 60 is preferably operative to cease operation of motors 70. Preferably, the rotatable members 30, and the respective masses 40 connected thereto, connected at each end of shakable member 20 are symmetrical and connected symmetrically. The symmetry allows torque to be applied to the wrist only in specific desired planes, thereby avoiding any unnecessary stress on the wrist.

In one embodiment optional acceleration sensor 100 is provided, acceleration sensor 100 being arranged to sense the actual acceleration, preferably in x,y,z components, of shakable member 20, thereby allowing control circuitry 60 to perform closed loop control of the actual shaking of shakable member 20. In an exemplary embodiment, random adjustment of at least one of the frequency of rotation and amplitude of rotation of the respective motors 70 is accomplished responsive to the output of optional acceleration sensor 100 thus providing for controlled irregular motion thereby constantly changing the eccentric forces applied to the user's wrist. In one embodiment irregular motion is provided in accordance with a predetermined pattern stored in control circuitry 60, and in another embodiment a random function if further provided.

In one embodiment rotatable members 30 are rotated in-phase and in another embodiment rotatable members 30 are rotated out of phase. In another embodiment rotatable members 30 are rotated in and out of phase according to a predetermined program, thereby constantly changing the eccentric forces applied to the user's wrist. In one embodiment a plurality of pre-determined programs for rotation speed and phase are provided to the user, for selection via optional user input device 110, as will be described further below in relation to FIGS. 4A and 4B. Adjusting the irregular rotation according to a pre-determined program allows a varied muscle construction-relaxation ratio thus improving muscle strength, blood circulation and flexibility. Additionally, preferably the difficulty level is increased gradually to prevent injury caused by excessive strain on "cold" muscle.

In one embodiment each of plurality of masses 40 can be replaced with a different mass 40, exhibiting a different weight, or additional masses may be added to the mass 40, thereby placing different eccentric forces on the user's hand. In one embodiment the location of each of plurality of masses 40 can be changed, thereby placing different eccentric forces on the user's hand, as will be described below in relation to FIG. 3. In one embodiment the pulse rate of the user is monitored and control circuitry 60 is operative to cease shaking of shakable member 20 if the pulse rate exceeds a predetermined level, as will be described below in relation to FIGS. 4A and 4B.

Figure 2:
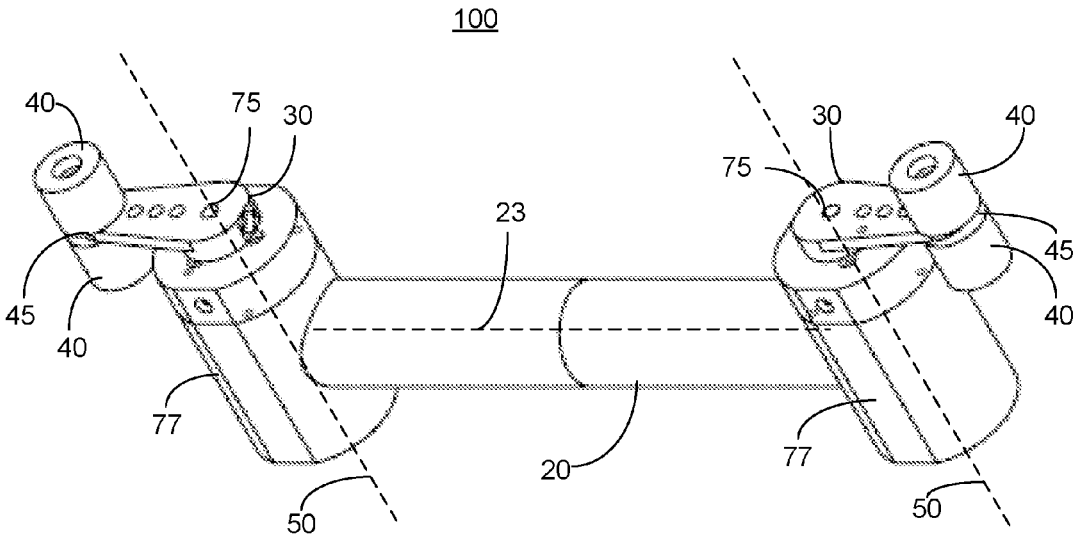
FIG. 2 illustrates a perspective view of a second embodiment of a portable device for training and exercising.

FIG. 2 illustrates a perspective view of a second embodiment of a portable device 100, comprising: a shakable member 20 exhibiting a longitudinal axis 23; a plurality of rotatable members 30; a plurality of masses 40; a plurality of centers of gravity 45 each associated with one or more masses 40; a plurality of longitudinal axes 50; a plurality of motors 70 (not shown) each exhibiting a rotating shaft 75; and a plurality of housings 77. Shakable member 20 comprises a control circuitry 60, battery 90, drivers 80, optional acceleration sensor 100 and optional user input 110 as described above in relation to FIGS. 1A -1C, not shown for clarity. In one non-limiting embodiment, as illustrated, shakable member 20 is a straight bar. Plurality of masses 40 are illustrated as circular masses, each connected to a particular rotatable member 30, however this is not meant to be limiting in any way and masses of any shape can be used. Two masses 40 are illustrated as being connected to each rotatable member 30, however this is not meant to be limiting in any way and any number of masses 40 can be connected to each rotatable member 30. Two rotatable members 30 are illustrated, however this is not meant to be limiting in any way and any number of rotatable members 30 can be provided. For each rotatable member 30 a center of gravity 45 is primarily defined by the positioning and shape of the respective attached masses 40.

Each end of shakable member 20 has connected thereto a respective housing 77, each housing 77 containing therein a respective motor 70 with a respective rotating shaft 75. Each housing 77 exhibits a respective longitudinal axis 50 running there through, preferably coincident with the axis of rotation of the respective rotating shaft 75. In an exemplary embodiment, the respective longitudinal axes 50 are perpendicular to longitudinal axis 23 of shakable member 20. Each motor 70 is associated with a particular rotatable member 30 connected to a distal end of the respective rotating shaft 75, and arranged to rotate responsive to rotation of the respective rotating shaft 75. In an exemplary embodiment, the rotational axis of each rotating shaft 75, the rotational axis of the respective rotatable member 30 and respective longitudinal axis 50 coincide. Each rotatable member 30 extends radially from the connection to the respective rotating shaft 75, and a pair of masses 40 is connected to each rotatable member 30 at a point distal of the longitudinal axis 50. The pair of masses 40 connected together exhibit a respective center of gravity 45. Thus masses 40 represent eccentric masses in respect to longitudinal axis 50, since center of gravity 45 is offset from longitudinal axis 50.

The operation of the portable device of FIG. 2 is in all respects similar the operation of device 10 of FIGS. 1A-1C, and thus in the interest of brevity is not further detailed.

Figure 3:
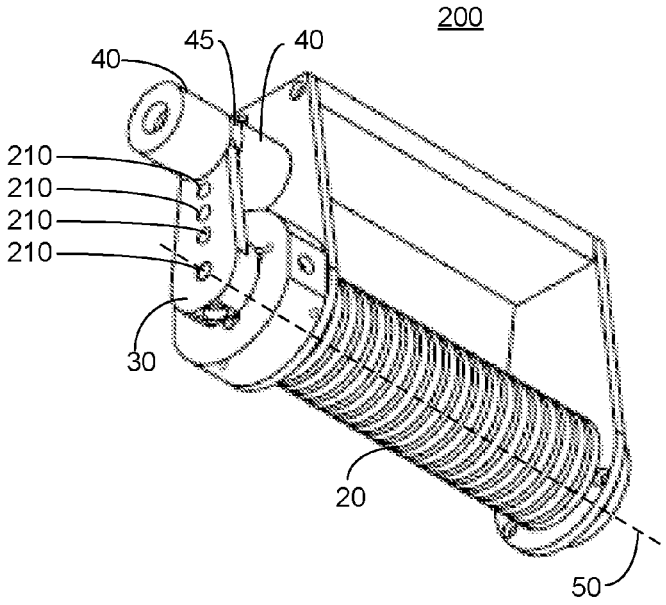
FIG. 3 illustrates a perspective view of a third embodiment of a portable device for training and exercising.

FIG. 3 illustrates a perspective view of a third embodiment of a portable device 200 suitable for training and exercising, comprising: a shakable member 20; a rotatable member 30; a plurality of masses 40 connected to rotatable member 30, exhibiting a common center of gravity 45; a longitudinal axis 50; and a plurality of connections 210. A single rotatable member 30 is connected to one end of shakable member 20, and masses 40 may be secured at any of a plurality of connections 210, thus providing for an adjustable offset between center of gravity 45 and longitudinal axis 50, resulting in an adjustable eccentric force. In all other respects the construction and operation of portable device 200 is similar to the construction and operation of portable device 10 of FIGS. 1A-1C, and thus in the interest of brevity is not described. Preferably each mass 40 is easily detached from and connected to connections 210.

Figure 4A:
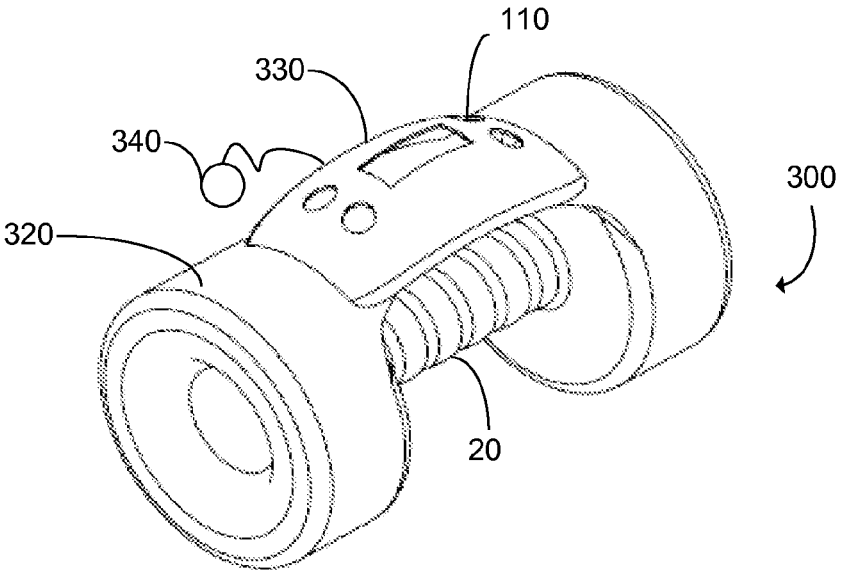
FIG. 4A illustrates a perspective view of a fourth embodiment of a portable device for training and exercising.
Figure 4B:
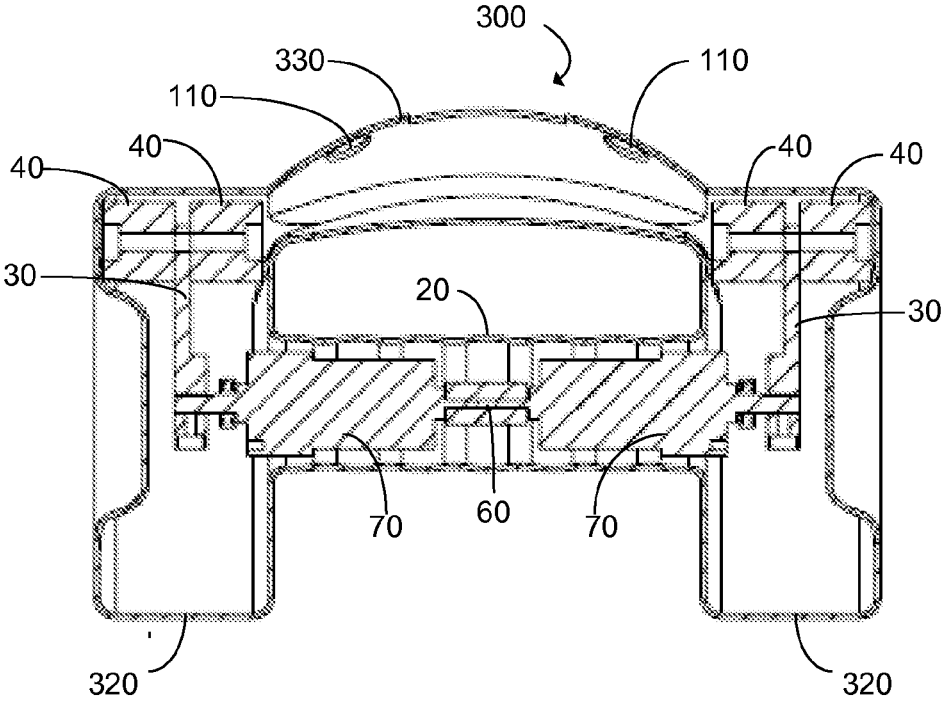
FIG. 4B illustrates a side cut view of the fourth embodiment of the portable device for training and exercising of FIG. 4A.

FIG. 4A illustrates a perspective view of a fourth embodiment of a portable device 300 and FIG. 4B illustrates a side cut view of the fourth embodiment of portable device 300, comprising: a housing 320; an input pad and display 330; and a pulse rate monitor 340. For ease of understanding FIGS. 4A and 4B will be described together. Optional user input device 110 is provided on input pad and display 330.

The construction of portable device 300 is as described above in relation to FIGS. 1A-1C, with housing 320 covering plurality of rotatable members 30 and plurality of masses 40, thereby removing any danger of injury from contact with rotating masses 40, with the exception that frame 25 is replaced with input pad and display 330 arranged to connect an end of each portion of housing 320 covering a respective rotatable member 30. Pulse rate monitor 340 is connected to control circuitry 60 (not shown), and display 330 is further connected to an output of control circuitry 60.

In one non-limiting embodiment user input device 110 comprises: an on/off switch; a start/stop switch; a mode switch enabling selection of one of a plurality of modes; and a level switch comprising a plurality of levels. The term "switch" includes any of a mechanical switch, a push button, a knob and a touch screen, without limitation. In operation, a user enables the on/off switch thereby powering on portable device 300. The user selects the desired mode. In one embodiment the plurality of modes comprises: a fixed shaking speed and amplitude mode, wherein masses 40 are rotated at a regular fixed speed; a gradually increased and decreased shaking speed and amplitude mode, wherein the amplitude of the irregular rotation of rotatable members 30 is gradually increased and then decreased; and a random mode, wherein the irregular rotation speed and amplitude and the phase relation of the plurality of masses 40 change according to a pre-determined program, seeming to the user as being random. The user then selects the level switch to select the desired difficulty level. In one embodiment the plurality of levels comprises a plurality of ranges of allowed rotation amplitudes and frequencies for rotatable members 30.

The user then enables the start/stop switch thereby causing control circuitry 60, via plurality of motors 70 and rotatable members 30, to rotate plurality of masses 40 thereby commencing shaking of shakable member 20, as described above. In one embodiment pulse rate monitor 340 is operative to monitor the pulse rate of the user and in the event that the pulse rate of the user exceeds a pre-determined value control circuitry 60 is operative to stop the rotation of plurality of masses 40, thereby ceasing the shaking of shakable member 20. In one embodiment the mode and level selections of the user are displayed on the LCD display of input pad and display 330. In one further embodiment the user's pulse rate, monitored by pulse rate monitor 340 is displayed on the LCD display of input pad and display 330.

Figure 5A:
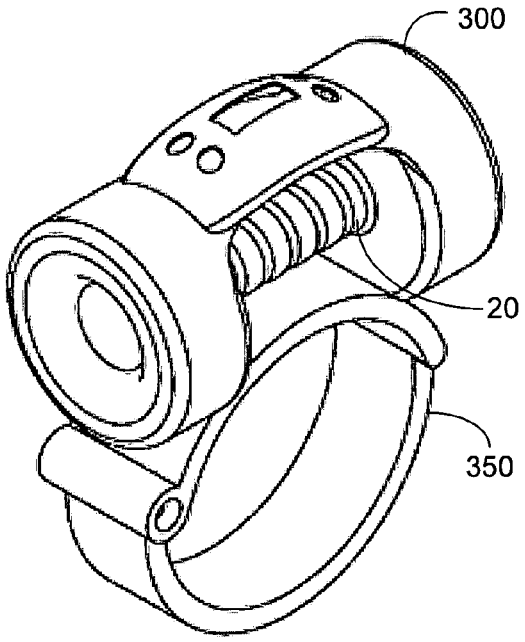
FIG. 5A illustrates a perspective view of the portable device for training and exercising of FIGS. 4A-4B comprising a leg adaptor.

FIG. 5A illustrates a perspective view of portable device 300 of FIGS. 4A and 4B, further comprising an extremity adaptor 350 adapted to receive therein a portion of a user's leg or arm, with extremity adaptor 350 secured in relation to shakable member 20 of portable device 300. In operation, as illustrated in FIG. 5D, a user attaches portable device 300 to the user's extremity utilizing extremity adaptor 350, thus providing exercise to a target leg muscle or arm as described above. Extremity adaptor 350 provides for an adjustable inner diameter so as to securely encase therein a portion of the user's extremity.

Figure 5B:
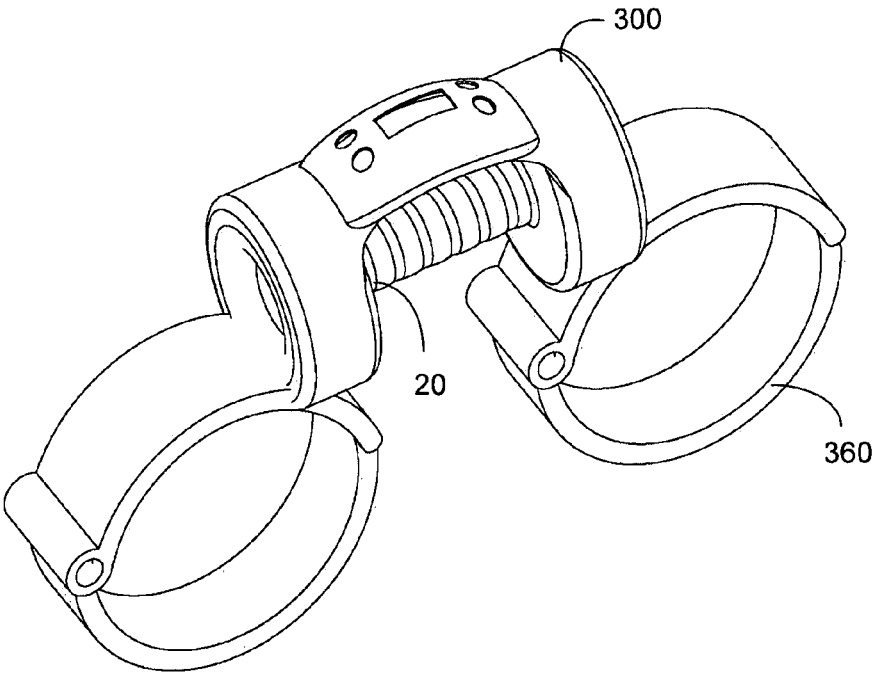
FIG. 5B illustrates a perspective view of the portable device of FIGS. 4A-4B adapted for pain relief and comprising a double leg adaptor.

FIG. 5B illustrates a perspective view of portable device 300 of FIGS. 4A and 4B, further comprising a double leg adaptor 360, each portion of double leg adaptor 360 adapted to receive therein a portion of a user's leg, preferably one of a calf portion or a thigh portion, with the diameter of each portion adjustable as described above in relation to extremity adaptor 350. Double leg adaptor 360 is secured in relation to shakable member 20 of portable device 300, thus transmitting any shaking of shakable member 20 to double leg adaptor 360 and to the user's leg portion inserted there within. In operation, and as illustrated in FIG. 5D, a user lies on a surface, with legs raised and inserted within double leg adaptor 360 and portable device 300 shakes the user's legs, and the shaking is transmitted via the user's skeleton to the lower back, thus providing lower back pain relief.

Figure 5C:
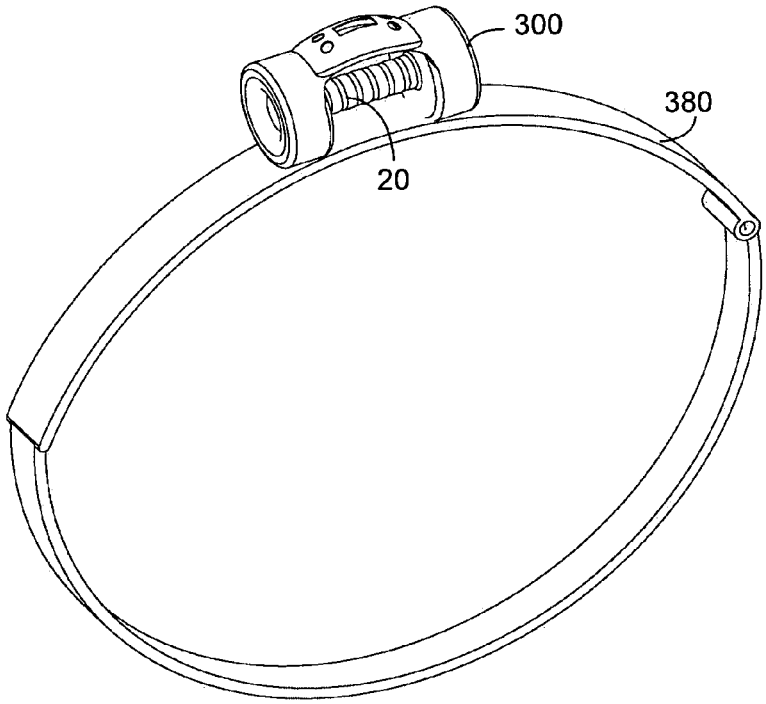
FIG. 5C illustrates a perspective view of the portable device of FIGS. 4A-4B adapted for pain relief and comprising an abdomen adaptor.
Figure 5D:
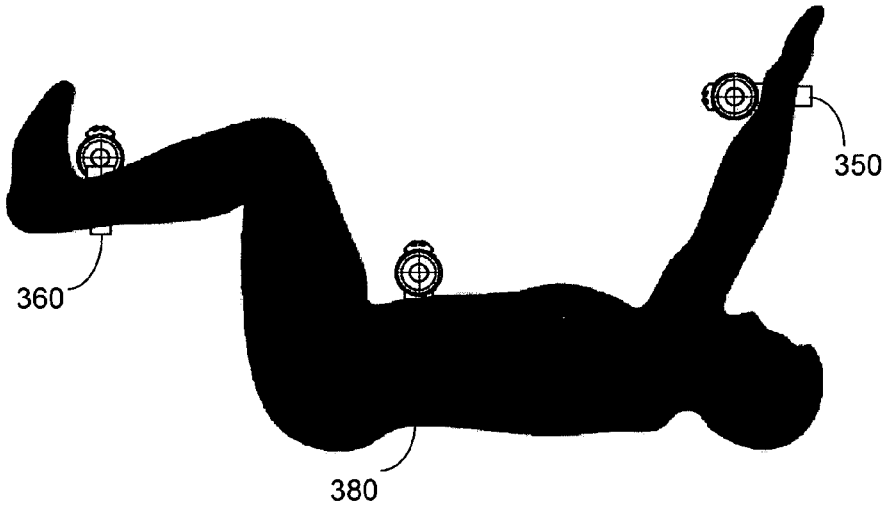
FIG. 5D illustrates a user in connection with each of the portable devices of FIGS. 5A-5C.

FIG. 5C illustrates a perspective view of portable device 300 of FIGS. 4A-4B, further comprising an abdomen adaptor 380, with abdomen adaptor 380 adapted to receive therein a portion of a user's abdomen. Abdomen adaptor 380 provides for an adjustable inner diameter, and in one embodiment is hinged at one end to allow for entry of the user's abdomen there within, so as to securely encase therein a portion of the user's abdomen. Abdomen adaptor 380 is secured in relation to shakable member 20 of portable device 300, thus transmitting any shaking of shakable member 20 to abdomen adaptor 380 and to a user's abdomen portion inserted there within. In operation, and as illustrated in FIG. 5D, a user lies on a surface with the user's abdomen encased within abdomen adaptor 380, preferably with legs raised. Portable device 300 shakes the user's abdomen, and the shaking is transmitted via the user's skeleton to the lower back, thus providing lower back pain relief.

FIG. 5D illustrates a user in connection with each of the portable devices 300 of FIGS. 5A-5C. There is no requirement that a user utilize all of the portable devices 300 of FIGS. 5A-5C simultaneously, and FIG. 5D simply provides an illustration of a potential location for use with each of the provided portable devices of FIGS. 5A-5C. In particular, extremity adaptor 350 is shown secured to a user's forearm, double leg adaptor 360 is shown secured to the user's legs, particularly at the calves, and abdomen adaptor 380 is shown secured to the user's abdomen.

Figure 6A:
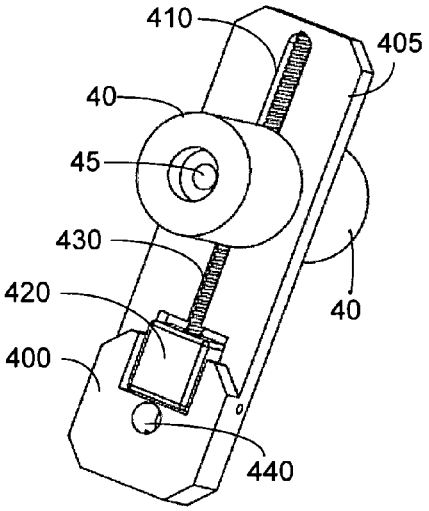
FIG. 6A illustrates a perspective view of a rotatable member of a fifth embodiment of a portable device for training and exercising.
Figure 6B:
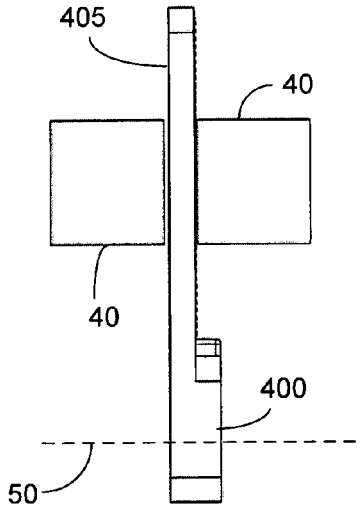
FIG. 6B illustrates a side view of the rotatable member of the fifth embodiment of the portable device for training and exercising of FIG. 6A.

FIG. 6A illustrates a perspective view of a rotatable member 400 of a fifth embodiment of a portable device and FIG. 6B illustrates a side view of rotatable member 400 of the fifth embodiment of the portable device, the views being taken together. Rotatable member 400 may be used to replace rotatable member 30 of any of portable device 10, portable device 100, portable device 200 and portable device 300, as described above. Rotatable member 400 comprises: a plurality of masses 40; a center of gravity 45 associated with masses 40; a longitudinal axis 50; a plate 405; a slit 410; a motor 420; a screw 430; and a connection hole 440. In one embodiment motor 420 is a stepper motor. Slit 410 is arranged along the center line of plate 405, preferably proceeding from one end of motor 420 axially away from connection hole 440. Motor 420 is placed within a detent arranged within slit 410 in proximity to connection hole 440. A pair of masses 40 is illustrated, however this is not meant to be limiting in any way and any number of masses can be provided, including, without limitation, a single mass 40. In one exemplary embodiment the rotational axis of rotatable member 400 and longitudinal axis 50 coincide.

Each of plurality of masses 40 is connected to screw 430 and screw 430 is longitudinally connected to the rotating shaft of motor 420. Screw 430 is placed within slit 410. Rotating shaft 75 of the respective motor 70 (not shown), as described above in relation to FIGS. 1A-1C, is placed in connection hole 440 and secured such that rotation of rotating shaft 75 results in rotation of rotatable member 400 around longitudinal axis 50. Masses 40 connected together exhibit a respective center of gravity 45. Thus masses 40 represent eccentric masses in respect to longitudinal axis 50, since center of gravity 45 is offset from longitudinal axis 50, as described above in relation to FIGS. 1A-1C.

In operation, the rotation of rotatable member 400 is in all aspects similar to the rotation of rotatable members 30 of FIGS. 1A-1C, and thus in the interest of brevity is not further detailed. Motor 420 is operative to rotate screw 430, thereby translating plurality of masses 40 longitudinally along slit 410, and thus providing for an adjustable offset between center of gravity 45 and longitudinal axis 50, resulting in an adjustable eccentric force. The operation of motor 420 is in one embodiment responsive to one or both of: a user input from a user input device, such as user input device 110 of FIGS. 4A and 4B; and a pre-determined program stored on control circuitry 60 of FIG. 1C.

Figure 7A:
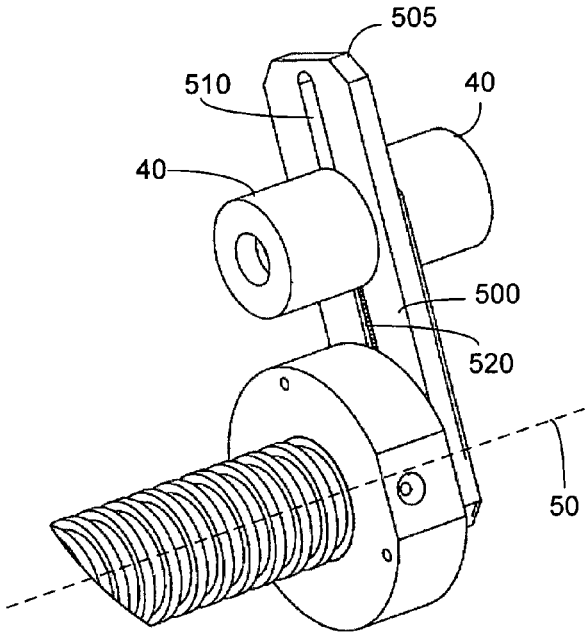
FIG. 7A illustrates a perspective view of a rotatable member of a sixth embodiment of a portable device for training and exercising.
Figure 7B:
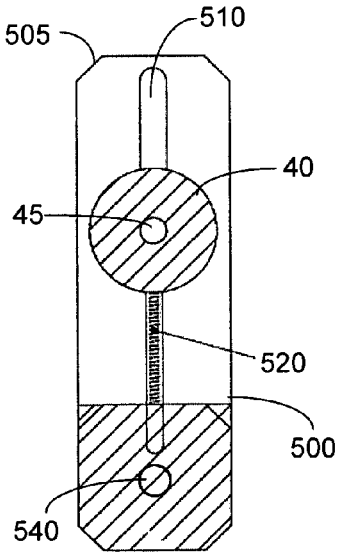
FIG. 7B illustrates a side view of the rotatable member of the sixth embodiment of the portable device for training and exercising of FIG. 7A.

FIG. 7A illustrates a perspective view of a rotatable member 500 of a sixth embodiment of a portable device and FIG. 7B illustrates a side view of rotatable member 500 of the sixth embodiment of the portable device, the views being taken together. Rotatable member 500 may be used to replace one or more of rotatable member 30 of any of portable device 10, portable device 100, portable device 200 and portable device 300, as described above. Rotatable member 500 comprises: a plurality of masses 40; a center of gravity 45 associated with masses 40; a longitudinal axis 50; a plate 505; a slit 510; a spring 520; and a connection hole 540. Slit 510 is arranged along the center line of plate 505, preferably proceeding axially away from the vicinity of connection hole 540. A pair of masses 40 is illustrated, however this is not meant to be limiting in any way and any number of masses 40 can be provided including, without limitation, a single mass 40. In one exemplary embodiment the rotational axis of rotatable member 500 and longitudinal axis 50 coincide. Masses 40 are arranged to travel longitudinally along slit 510 responsive to the action of spring 520. Masses 40 are connected to one end of spring 520, and the second end of spring 520 is secured to the end of slit 510 defined by the vicinity of connection hole 540. Connection hole 540 is arranged for connection to rotating shaft 75 of motor 70 as described above in relation to FIGS. 1A-1C.

The pair of masses 40 connected together exhibit a respective center of gravity 45. Thus masses 40 represent eccentric masses in respect to longitudinal axis 50, since center of gravity 45 is offset from longitudinal axis 50, as described above in relation to FIGS. 1A-1C.

In operation, the rotation of rotatable member 500 is in all aspects similar to the rotation of rotatable members 30 of FIGS. 1A-1C, and thus in the interest of brevity is not further detailed. As rotatable member 500 is rotated masses 40 are translated along slit 510 responsive to the combination of the action of spring 520 and the force of gravity. In particular, when masses 40 begin to travel upwards, both gravity and the force of spring 520 act to reduce the amount of offset; and when masses 40 begin to travel downwards, gravity attempts to extend the amount of offset which is resisted by the force of spring 520. Thus, as rotatable member 500 is rotated the amount of offset changes during the rotational cycle, adding to the eccentricity. The speed of translation of masses 40 is determined by the spring constant of spring 520 and the amount of masses 40. Masses 40 are not fixed during a rotation cycle of rotating shaft 75, and thus represent free masses.

Figure 8:
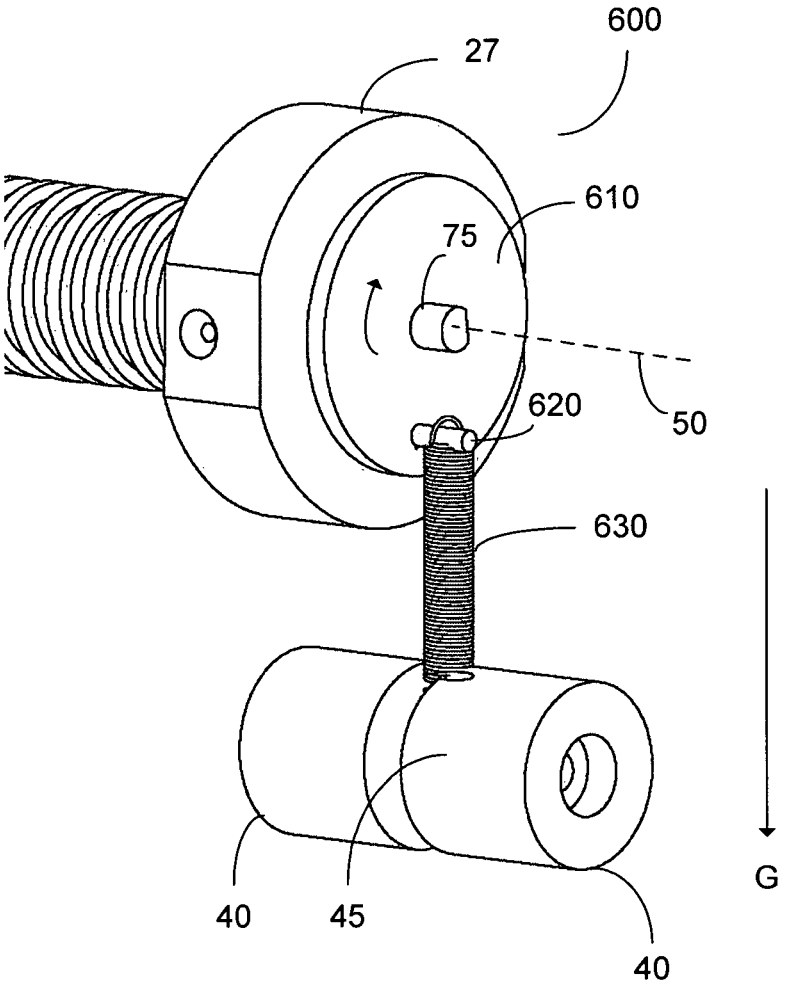
FIG. 8 illustrates a perspective view of a rotatable member of a seventh embodiment of a portable device for training and exercising.

FIG. 8 illustrates a perspective view of a rotatable member 600 of a seventh embodiment of a portable device. Rotatable member 600 may be used to replace one or more of rotatable member 30 of any of portable device 10, portable device 100, portable device 200 and portable device 300, as described above. Rotatable member 600 comprises: a plurality of masses 40; a center of gravity 45 associated with one or more masses 40; a longitudinal axis 50; a rotating member 610; an extending member 620; and a connecting member 630. Further shown are nut 27 and an end of rotating shaft 75 of motor 70, the direction of rotation of rotating member 610 and the direction of the force of gravity, as indicated by the letter G. Rotating shaft 75, whose longitudinal axis defines longitudinal axis 50, protrudes through nut 27 and into a center hole of rotating member 610 and is secured therein. Extending member 620 is secured to rotating member 610 radially removed from rotating shaft 75. A first end of connecting member 630 is connected to extending member 620 and a second end of connecting member 630 is secured to the plurality of masses 40, preferably on, or near, center of gravity 45. In an exemplary embodiment connecting member 630 is composed of a non-rigid substance, such as a spring material, or other compliant material.

In operation, the rotation of rotating shaft 75, responsive to the respective motor 70, as described above in relation to FIGS. 1A-1C, rotates rotating member 610, as indicated by the arrow. The rotation of rotating member 610 is operative to move masses 40 exclusively in line with the force of gravity, G, without providing any lateral movement, due to the compliance of extending member 620. In one particular embodiment, masses 40 are not fixed during a rotation cycle of shaft 75, and thus represent free masses.

Figure 9:
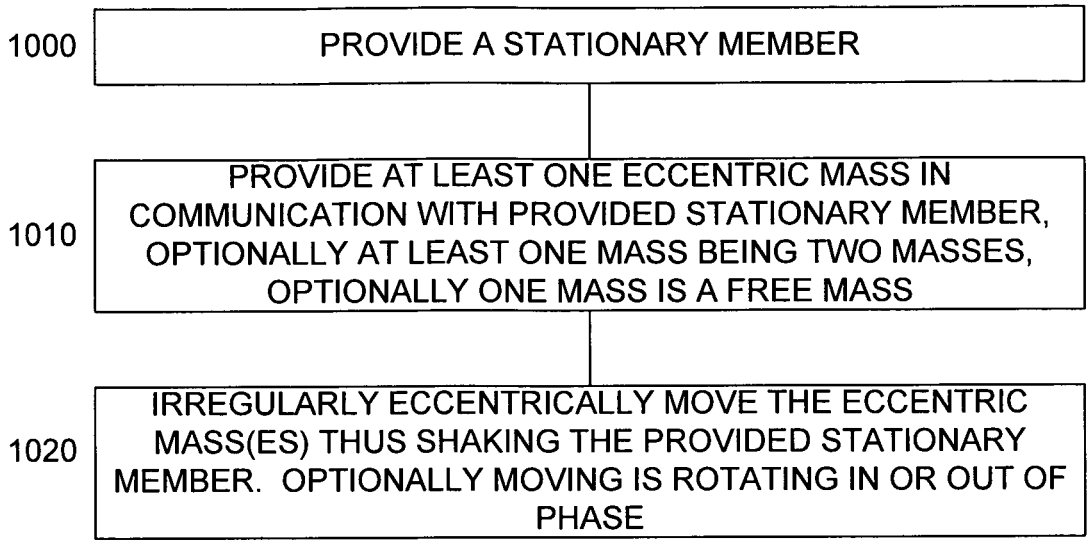
FIG. 9 illustrates a high level flow chart of a method for providing training and exercising.

FIG. 9 illustrates a high level flow chart of a method for providing training and exercising. In stage 1000 a member, such as shakable member 20, is provided. In stage 1010 at least one eccentric mass is provided in communication with the member of stage 1000. In one embodiment a rotational member, such as rotational member 30, connects the member with the at least one eccentric mass. In one embodiment the at least one eccentric mass comprises two eccentric masses. In another embodiment the at least one eccentric mass comprises one eccentric mass. In one embodiment, as described above in relation to FIGS. 7A-7B and 8, at least one free mass is further provided in communication with the member of stage 1000.

In stage 1020 the at least one eccentric mass is irregularly eccentrically moved thereby causing the member to shake. In one embodiment the at least one eccentric mass is rotated at changing frequencies and amplitudes according to a pre-determined program. In one further embodiment the pre-determined program is selected responsive to a user input. In one embodiment the eccentric masses are rotated in phase according to a pre-determined program, and in another embodiment the eccentric masses are rotated out of phase according to a pre-determined program. In one further embodiment the pre-determined program is selected responsive to a user input.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description.

The invention claimed is:

1. A portable device comprising:

a shakable member;

at least one rotational member in communication with said shakable member, each of said at least one rotational member exhibiting a respective axis of rotation;

at least one mass exhibiting a center of gravity, each of said at least one mass in communication with a particular one of said at least one rotational member, said center of gravity of each mass offset from the axis of rotation of the respective rotational member;

at least one motor in communication with said at least one rotational member and arranged to rotate said at least one rotational member about the respective axis of rotation thereof, wherein the rotational axis of said at least one rotational member is perpendicular to a longitudinal axis of said shakable member; and a control circuitry in communication with said at least one motor, said control circuitry arranged to operate said at least one motor so as to irregularly rotate said at least one rotational member to thereby shake said shakable member.

2. The portable device according to claim 1, wherein said irregular rotation comprises a random adjustment of one of frequency and amplitude of rotation.

3. The portable device according to claim 1, wherein said shakable member is a straight bar.

4. The portable device according to claim 1, wherein said at least one rotational member comprises two rotational members and said at least one mass comprises two masses.

5. The portable device according to claim 4, wherein said control circuitry is arranged to rotate said two rotational members such that said two masses rotate in-phase.

6. The portable device according to claim 4, wherein said control circuitry is arranged to rotate said two rotational members such that said two masses rotate out of phase.

7. The portable device according to claim 1, wherein the amount of said offset is adjustable.

8. The portable device according to claim 1, further comprising a user input device in communication with said control circuitry, said control circuitry arranged to select a range of rotational frequencies responsive to said user input device.

9. A method for training, exercising or pain relief, the method comprising:

providing a shakable member;

providing at least one eccentric mass in communication with the provided shakable member; and irregularly eccentrically moving the provided at least one eccentric mass, said irregular eccentric motion of the provided at least one eccentric mass shaking the provided shakable member, wherein said provided at least one eccentric mass comprises:

at least one rotational member in communication with said provided shakable member; and at least one mass exhibiting a center of gravity, each of said at least one mass in communication with a particular one of said at least one rotational member, said center of gravity of each mass offset from the axis of rotation of the respective rotational member, each of said at least one rotational member exhibiting a respective axis of rotation, the rotational axis of said at least one rotational member perpendicular to a longitudinal axis of said provided shakable member.

10. The method according to claim 9, wherein said irregularly eccentrically moving of the provided at least one eccentric mass comprises irregularly eccentrically rotating the provided at least one eccentric mass.

11. The method according to claim 10, wherein said irregularly eccentrically rotating comprises randomly adjusting one of frequency of rotation and amplitude of rotation.

12. The method according to claim 10, wherein said irregularly eccentrically rotation of the provided at least one eccentric mass is about an adjustable rotational radius.

13. The method according to claim 9, wherein the provided at least one eccentric mass comprises two eccentric masses.

14. The method according to claim 13, wherein said irregularly eccentrically moving of the provided two eccentric masses comprises irregularly eccentrically rotating the provided two eccentric masses in-phase.

15. The method according to claim 13, wherein said irregularly eccentrically moving of the provided two eccentric masses comprises irregularly eccentrically rotating the provided two eccentric masses out of phase.

* * * * *